US006817367B2

(12) United States Patent
Flowers et al.

(10) Patent No.: US 6,817,367 B2
(45) Date of Patent: Nov. 16, 2004

(54) LIQUID CONTAINMENT SYSTEM FOR A DISHWASHER

(75) Inventors: Christopher L. Flowers, Humboldt, TN (US); Chad M. Thomas, Jackson, TN (US)

(73) Assignee: Maytag Corporation, Newton, IA (US)

( * ) Notice: Subject to any disclaimer, the term of this patent is extended or adjusted under 35 U.S.C. 154(b) by 79 days.

(21) Appl. No.: 10/385,611

(22) Filed: Mar. 12, 2003

(65) Prior Publication Data

US 2004/0177866 A1 Sep. 16, 2004

(51) Int. Cl.[7] ..... B08B 9/20; A47L 15/42

(52) U.S. Cl. ..... 134/25.2; 134/182; 134/200

(58) Field of Search ..... 134/25.2, 10, 42, 134/57 D, 56 D, 182, 183, 200, 101, 117; 68/196

(56) References Cited

U.S. PATENT DOCUMENTS 3,908,854 A * 9/1975 Long ..... 220/656
4,998,550 A 3/1991 Archambault
5,031,651 A 7/1991 Spiegel et al.
5,115,826 A 5/1992 Bertsch et al.
5,758,676 A * 6/1998 Duckwall et al. ..... 134/201
5,836,324 A 11/1998 Johnson et al.
6,006,767 A 12/1999 Hecker et al.

* cited by examiner

*Primary Examiner*—Frankie L. Stinson
*Assistant Examiner*—Saeed Chaudhry
(74) *Attorney, Agent, or Firm*—Diederiks & Whitelaw, PLC

(57) ABSTRACT

A dishwasher tub is provided with containment structure which prevents liquid from leaking around a door seal. The containment structure includes a bead that extends along side portions of a front flange of the dishwasher tub. At each lower portion of the front flange, the bead includes an inward and downward extending portion which leads to a substantially vertical portion, and finally to another inward and downward extending portion. The final two portions of the bead are arranged along a reduced dimension section of the front flange and define a trough which guides the liquid back into the tub.

23 Claims, 3 Drawing Sheets

LIQUID CONTAINMENT SYSTEM FOR A DISHWASHER

BACKGROUND OF THE INVENTION

1. Field of the Invention

The present invention pertains to the art of dishwashers and, more particularly, to a system for preventing wash liquid from leaking about a door opening of a dishwasher.

2. Discussion of the Prior Art

In a typical dishwasher, washing fluid is pumped from a sump into upper and lower wash arms such that kitchenware retained on vertically spaced racks within a tub of the dishwasher will be sprayed with the washing fluid for cleaning purposes. The washing fluid is heated, filtered and recirculated. Prior to recirculating the washing fluid, the fluid is directed through one or more filters to remove soil from the fluid, with the soil being collected in a chamber. Periodically, the system will be purged in order to drain the collection chamber of the soil.

Typically, a dishwasher will be provided with a seal mounted around a door opening, wherein the seal is compressed when the dishwasher door is closed in order to prevent liquid from leaking from the tub based on a washing operation. Since the seal is compressed, it usually takes the shape of a portion of the door, such as a door spike, that is pushing into the seal. Unfortunately, repeated compression of the seal can cause the seal to deform. Over time, this deformation can cause the seal to leak.

To address this problem, the assignee of the present application has previously modified the flange structure provided about a door opening of a dishwasher tub in an attempt to direct leaking liquid back into the tub. To this end, it has been proposed to form each side flange with a laterally outermost ridge which angles inwardly and terminates at a position spaced from a lowermost portion of the door opening. With this structure, water or other washing liquid which leaks past the seal can be caused to flow along the ridge and be directed back towards the tub.

Regardless of this proposed solution to this leakage problem, it has been found that the prior ridge arrangement exhibited only limited success in preventing leakage. For instance, given the structure and configuration of the ridge, the liquid was accorded the opportunity of being re-directed laterally outwardly below the ridge or the liquid could flow over the ridge if relatively high flow rates were experienced. Based on the above, there exists a need in the art for an improved arrangement to prevent liquid from leaking about a door opening of a dishwasher door.

SUMMARY OF THE INVENTION

The present invention is directed to preventing the leakage of liquid from around a door opening of a dishwasher door, even if a seal provided about the opening is deformed due to being repetitively compressed. In accordance with the present invention, a flange is provided about a door opening of a dishwasher tub laterally outwardly of a seal which is caused to be compressed upon closing of the door. At lower lateral portions of the flange, a bead, including various segments, is formed to re-direct any liquid leaking past the seal back into the tub.

The bead in accordance with the preferred embodiment of the invention includes a first, elongated and substantially vertically extending portion, a second downwardly and laterally inwardly extending portion, another vertically extending portion, and a lowermost, inwardly angled portion. The second vertically extending portion is spaced laterally inwardly of the first vertically extending portion and extends adjacent an inwardly directed wall portion of the tub, near the seal, in order to define an elongated guide trough. In addition, in accordance with the most preferred embodiment of the invention, the flange has a reduced dimension along both the second vertically extending portion and the lowermost angled portion, with the lowermost angled portion making a smooth transition into the washing chamber.

With this overall arrangement, any liquid leaking past the seal, whether by the splashing of liquid in the tub or through condensation, is initially directed down along the first vertically extending portion. The liquid is then directed laterally inwardly to the point at which the guide trough starts. Thereafter, the liquid is further directed along the second vertically extending portion directly adjacent the interior of the tub. Finally, if the liquid reaches the end of the bead, it reaches the lowermost angled portion which directs the liquid to flow back into the tub.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
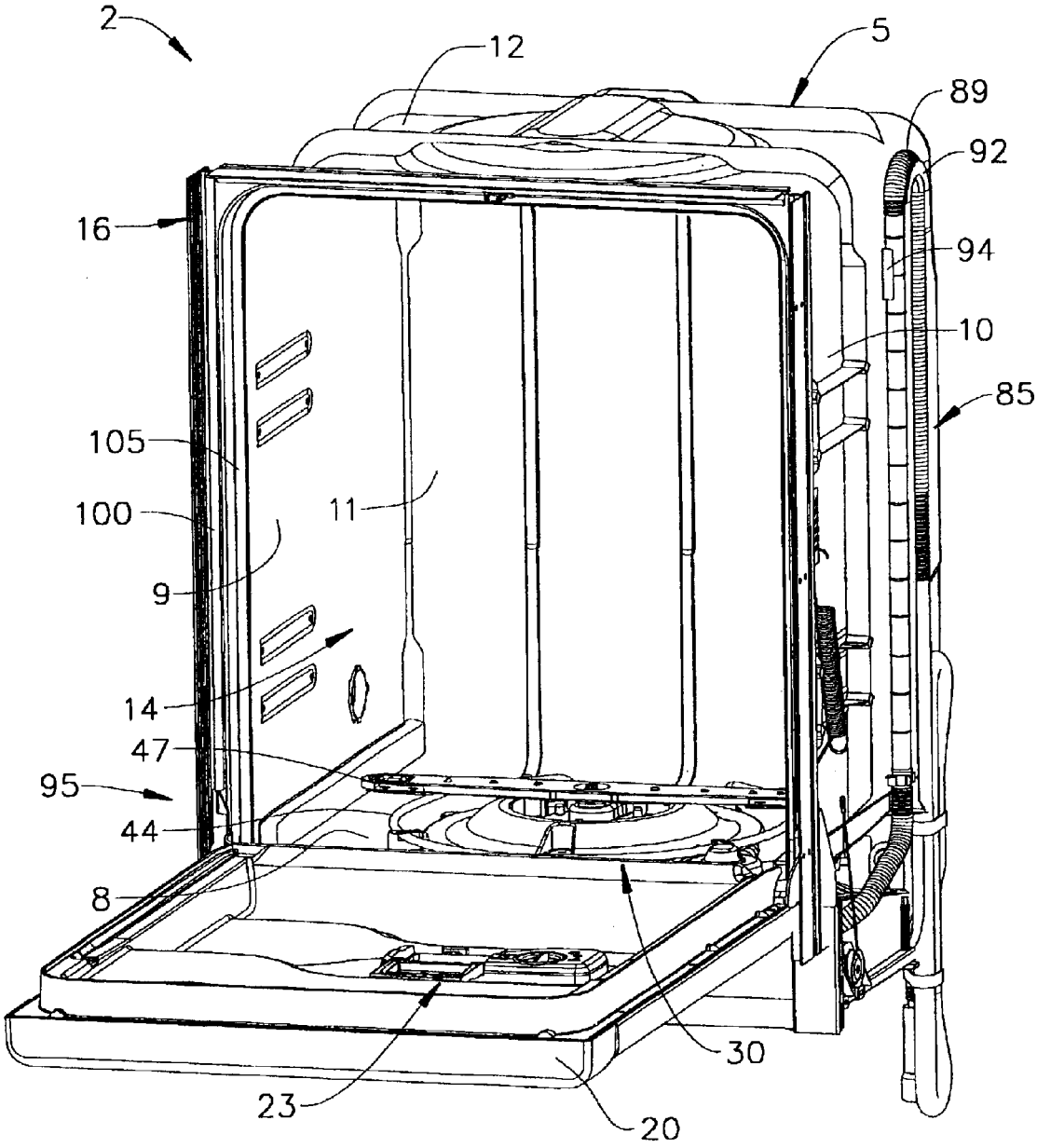
FIG. 1 is an upper right perspective view of a dishwasher constructed in accordance with the present invention, with a door of the dishwasher being open to illustrate internal tub structure.

With initial reference to FIG. 1, a dishwasher constructed in accordance with the present invention as generally indicated at 2. As shown, dishwasher 2 includes a tub 5 which is preferably injection molded of plastic so as to include integral bottom, side, rear and top walls 8–12 respectively. Within the confines of walls 8–12, tub 5 defines a washing chamber 14 within which soiled kitchenware is adapted to be placed upon shiftable upper and lower racks (not shown), with the kitchenware being cleaned during a washing operation in a manner widely known in the art. Tub 5 has attached thereto a frontal frame 16 which pivotally supports a door 20 used to seal chamber 14 during a washing operation. In connection with the washing operation, door 20 is preferably provided with a detergent tray assembly 23 within which a is consumer can place liquid or particulate washing detergent for dispensing at predetermined portions of the washing operation. Of course, dispensing detergent in this fashion is known in the art such that this arrangement is only being described for the sake of completeness.

Disposed within tub 5 and, more specifically, mounted within a central opening formed in bottom wall 8 of tub 5, is a pump and filter assembly 30. Extending about a substantial portion of pump and filter assembly 30, at a position raised above bottom wall 8, is a heating element 44. In a manner known in the art, heating element 44 preferably takes the form of a sheath, electric resistance-type heating element.

In general, pump and filter assembly 30 is adapted to direct washing fluid to a lower wash arm 47 and an upper wash arm (not shown). Dishwasher 2 has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In any event, in this manner, an upper loop is maintained in drain hose 85 to assure proper drainage in a manner known in the art. Actually, a detailed description of the exact structure and operation of pump and filter assembly 30 of dishwasher 2 does not form part of the present invention, but is rather set forth in pending U.S. application Ser. No. 10/186,739 entitled "Dishwasher Pump and Filtration System" filed Jul. 2, 2002, incorporated herein by reference.

Instead, the present invention is directed to the inclusion of liquid containment structure, generally indicated at 95, provided along each of side walls 9 and 10 for preventing the leakage of wash liquid from around dishwasher door 20. More specifically, frontal frame 16 actually extends along an outwardly projecting front flange 100 formed integral with both side walls 9, 10 and top wall 12. A front surface 101 (see FIGS. 2 and 3) leads to an in-turned wall portion 102 of side wall 9 which, in turn, leads to a flat wall strip 103. Wall strip 103 carries an elongated gasket or seal 105, between in-turned wall portion 102 and an extension 108 of side wall 9, against which door 20 seats in order to seal off washing chamber 14 during operation of dishwasher 2. That is, seal 105 is caused to be compressed upon closing of door 20 to prevent washing liquid, whether water or a combination of water and detergent, from flowing outside of dishwasher 2.

Figure 2:
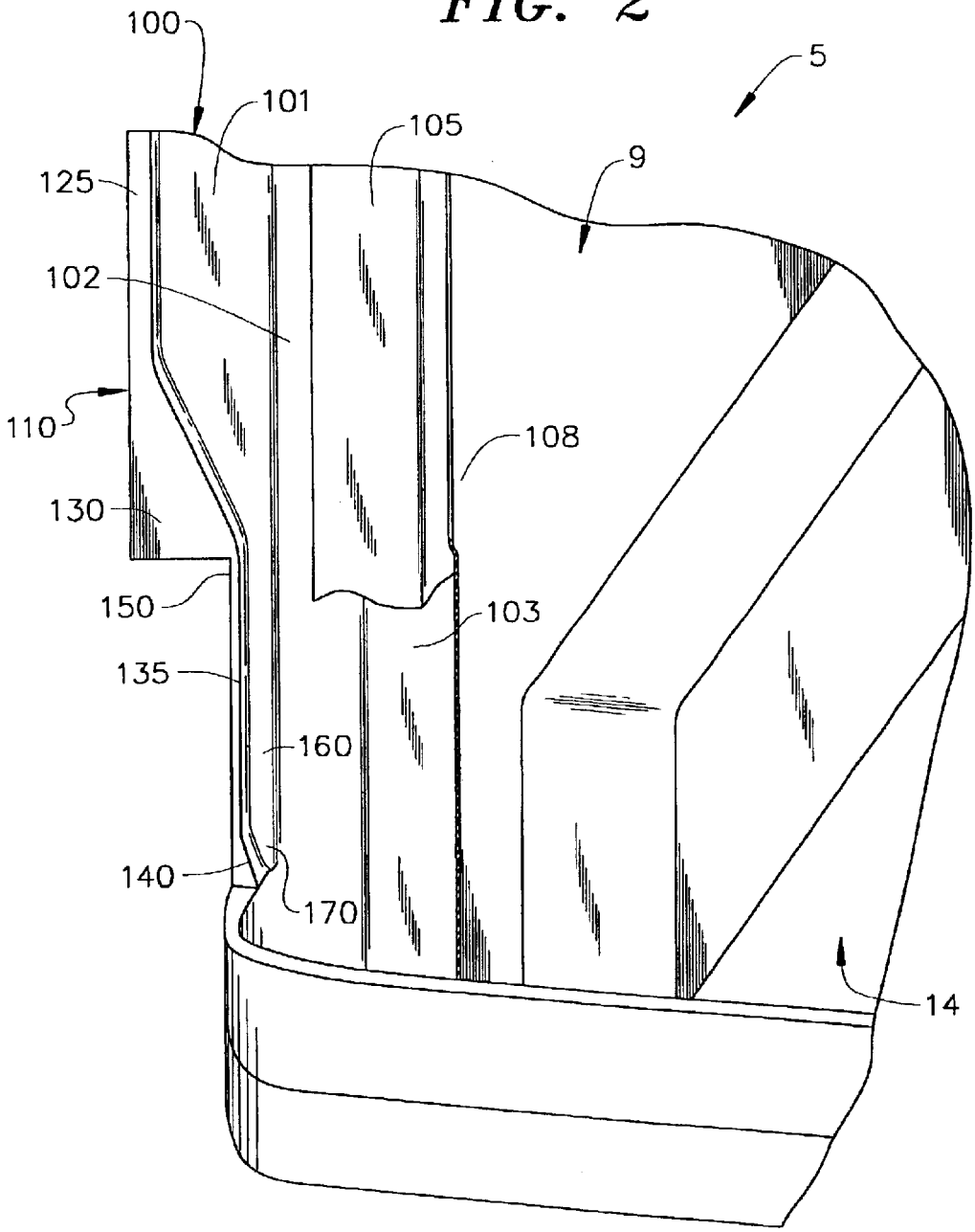
FIG. 2 is an enlarged perspective view of a lower corner portion of the tub of FIG. 1.
Figure 3:
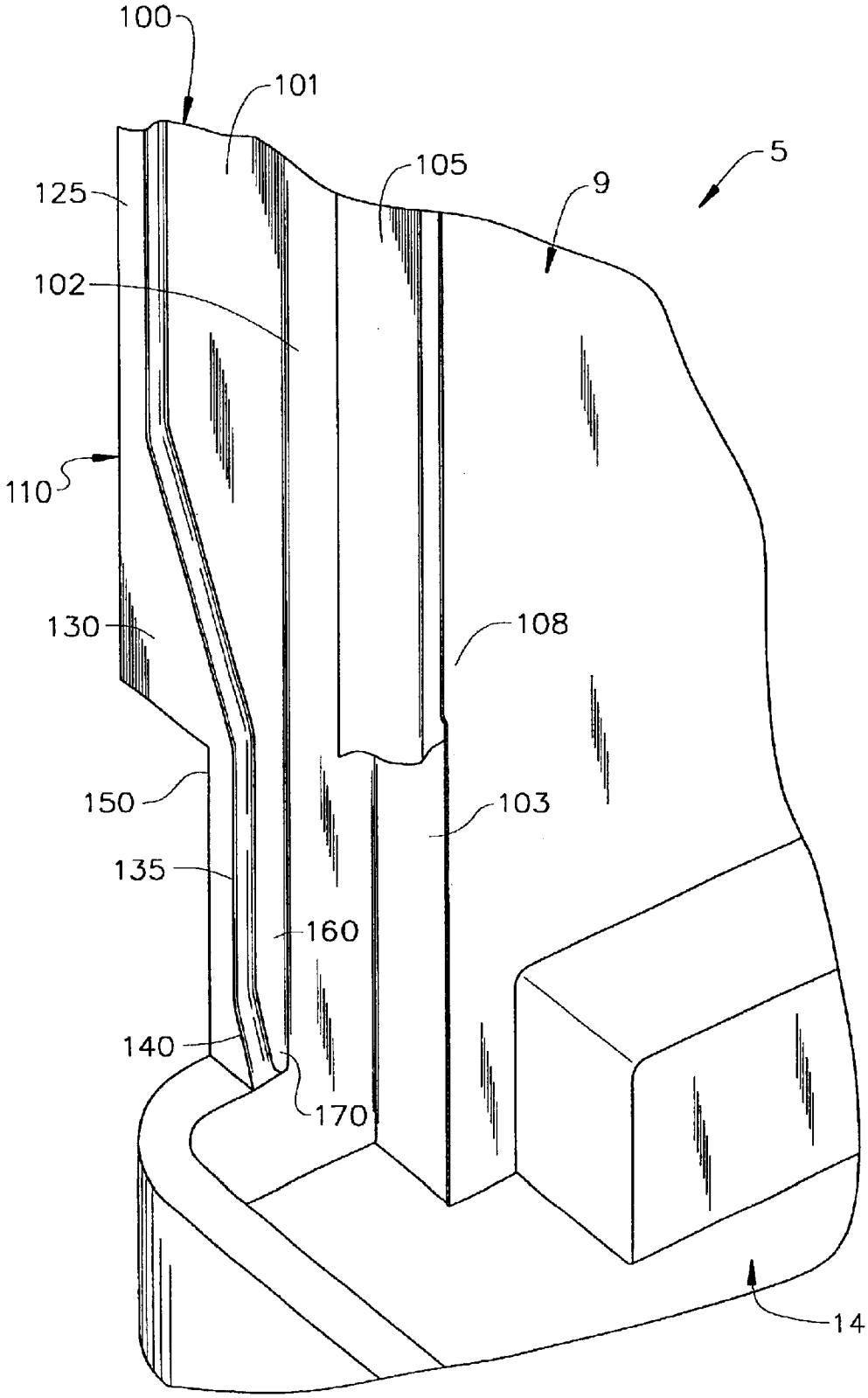
FIG. 3 is another perspective view of the lower corner portion of the tub of FIG. 1.

FIGS. 2 and 3 best show the arrangement of front flange 100 and containment structure 95. Here it should be noted that seal 105 is only shown in part for the sake of clarity. As depicted, front flange 100 is formed with an outermost, forwardly projecting ridge or bead generally indicated at 110 which functions to re-direct any wash liquid leaking past seal 105 back into tub 5. More specifically, bead 110 includes various segments, i.e., a first, elongated and substantially vertically extending portion 125 leading to a downwardly and laterally inwardly extending portion 130, followed by another vertically extending portion 135, and terminating in a lowermost, inwardly angled portion 140. With this arrangement, containment structure 95 is raised to a plane offset from a plane of front surface 101, with bead portion 130 essentially defining a generally triangular-shaped plateau.

At this point, it should be recognized that front flange 100, through to and including bead portions 125 and 130, has heretofore been utilized by the assignee of the present invention for the purpose of diverting any leakage past seal 105 back into tub 5. However, in accordance with the present invention, front flange 100 has been modified from this prior arrangement and bead portions 135 and 140 have been effectively added. More particularly, front flange 100 in accordance with the invention has been provided with a cut-out 150 so as to define a reduced dimensional portion of front flange 100 along which bead portions 135 and 140 extend. The presence of cut-out 150 advantageously enables a compact hinge arrangement (not shown) for door 20 to be employed. As shown, second vertically extending portion 135 is spaced laterally inwardly of the first vertically extending portion 125 and is spaced from in-turned wall portion 102 by an elongated guide trough 160. As indicated above, second vertically extending portion 125 leads to inwardly angled portion 140 which, in turn, tapers to a corner juncture 170 between guide trough 160 of front flange 100 and in-turned wall portion 102 of tub 5.

During operation of dishwasher 2, any liquid leaking past seal 105, whether from the spraying of washing liquid or, particularly, condensation, is initially directed down along first vertically extending portion 125. The liquid is then directed laterally inwardly, due to the presence of bead portion 130, to the point at which guide trough 160 starts. Thereafter, the liquid is further directed within guide trough 160 along second vertically extending portion 135. Finally, if the liquid reaches the end of containment structure 95, it comes upon lowermost angled portion 140 which smoothly transitions the liquid to flow back into tub 5. Therefore, with this arrangement, even if seal 105 becomes deformed by repeatedly being compressed upon the closing of door 20, any resulting liquid flow along front flange 100 will be contained within tub 5 instead of leaking to the surrounding environment.

Although described with reference to a preferred embodiment of the invention, it should be readily understood that various changes and/or modifications can be made to the invention without departing from the spirit thereof. For instance, although seal 105 is typically mounted to tub 5, seal 105 could actually be carried by door 20, while seating against tub 5. In addition, bead 110 is preferably formed integral with tub 5, but could be constituted by one or more separate elements mounted to tub 5 to perform the liquid containment function. Surprisingly, it has been found that containment structure 95, in combination with the generally serpentine flow path from washing chamber 14 outwardly to front flange 100, prevents leakage from washing chamber 14 of dishwasher 2 even when seal 105 is removed or severely damaged. In any case, the invention is only intended to be limited by the scope of the following claims.

We claim:

1. A dishwasher for receiving and cleansing soiled kitchenware by spraying washing fluid onto the kitchenware from at least one wash arm comprising:

a tub having bottom, opposing side, rear and top walls which collectively define a washing chamber, said tub including a front flange;

a door mounted for movement relative to the tub for exposing the washing chamber;

a seal arranged between the tub and the door upon closing of the door in order to seal the washing chamber; and liquid containment structure provided along the front flange, said liquid containment structure including a substantially vertically extending portion, an angled portion, and a guide trough, wherein liquid leaking about the seal is directed along the substantially vertically extending portion of the liquid containment structure, redirected laterally inward by the angled portion, led to the guide trough, and guided back into the tub.

2. The dishwasher according to claim 1, wherein the liquid containment structure is constituted by a plurality of sequential, raised bead portions extending along the front flange.

3. The dishwasher according to claim 1, wherein the guide trough is defined, at least in part, by another substantially vertically extending portion of the liquid containment structure.

4. The dishwasher according to claim 3, wherein the guide trough is further defined by another angled portion arranged at a lowermost portion of the liquid containment structure.

5. The dishwasher according to claim 4, wherein said another angled portion of the liquid containment structure smoothly transitions into the tub.

6. The dishwasher according to claim 3, wherein the guide trough is defined in a reduced dimensional portion of the front flange.

7. The dishwasher according to claim 1, wherein the seal is located inwardly of the front flange.

8. A dishwasher for receiving and cleansing soiled kitchenware by spraying washing fluid onto the kitchenware from at least one wash arm comprising:

a tub having bottom, opposing side, rear and top walls which collectively define a washing chamber, said tub including a front flange;

a door mounted for movement relative to the tub for exposing the washing chamber, said door being adapted to be sealed to the tub during operation of the dishwasher; and liquid containment structure provided along the front flange, said liquid containment structure including a first, substantially vertically extending bead portion, a first inwardly angled bead portion, a second, substantially vertically extending bead portion, and a second inwardly angled bead portion, wherein liquid leaking about the door is directed along the first vertically extending bead portion of the liquid containment structure, is redirected laterally inward by the first angled bead portion, flows along the second vertically extending bead portion, and is guided back into the tub by the second angled bead portion.

9. The dishwasher according to claim 8, wherein the second vertically extending bead portion and the second angled bead portion define a guide trough of the liquid containment structure.

10. The dishwasher according to claim 9, wherein the guide trough is defined in a reduced dimensional portion of the front flange.

11. The dishwasher according to claim 8, wherein second angled bead portion of the liquid containment structure smoothly transitions into the tub.

12. The dishwasher according to claim 8, further comprising: a seal arranged between the tub and the door upon closing of the door in order to seal the washing chamber.

13. The dishwasher according to claim 12, wherein the seal is located inwardly of the front flange.

14. A dishwasher for receiving and cleansing soiled kitchenware by spraying washing fluid onto the kitchenware from at least one wash arm comprising:

a tub having bottom, opposing side, rear and top walls which collectively define a washing chamber, said tub including a front flange, said front flange including side portions extending along the side walls, with a lower section of each of the side portions being provided with a cut-out so as to define a laterally reduced dimensional portion of the front flange;

a door mounted for movement relative to the tub for exposing the washing chamber;

a seal arranged between the tub and the door upon closing of the door in order to seal the washing chamber; and liquid containment structure provided along at least the laterally reduced dimensional portion of the front flange on each of the side portions for directing liquid leaking from the washing chamber back into the tub.

15. The dishwasher according to claim 14, wherein the liquid containment structure includes a guide trough.

16. The dishwasher according to claim 14, wherein the liquid containment structure includes a substantially vertically extending bead portion extending along the laterally reduced dimensional section.

17. The dishwasher according to claim 16, wherein the liquid containment structure further includes an angled bead portion, downstream of the substantially vertically extending bead portion, along the laterally reduced dimensional section.

18. The dishwasher according to claim 17, wherein said angled bead portion of the liquid containment structure smoothly transitions into the tub.

19. The dishwasher according to claim 14, wherein the seal is located inwardly of the front flange.

20. The dishwasher according to claim 14, wherein the liquid containment structure is constituted by a plurality of sequential, raised bead portions extending along the front flange.

21. A method of containing liquid leaking past a door seal of a dishwasher through the use of containment structure provided along a front flange of a tub of the dishwasher comprising:

directing the leaking liquid along a first vertically extending bead portion of the containment structure;

redirecting the liquid laterally inward by a first angled bead portion provided on the front flange; and causing the liquid to flow along a guide trough defined along a lowermost portion of the front flange.

22. The method of claim 21, wherein the step of causing the liquid to flow along the guide trough includes:

directing the liquid along a second vertically extending bead portion of the containment structure; and guiding the liquid back into the tub by a second angled bead portion.

23. The method of claim 21, wherein the liquid is caused to flow along the guide trough in a reduced dimensional portion of the front flange.

* * * * *